US005567065A

United States Patent [19]

Cai et al.

[11] Patent Number: 5,567,065

[45] Date of Patent: Oct. 22, 1996

[54] INK RIBBON CASSETTE

[75] Inventors: Zheng L. Cai; Yasuhito Imae, both of Osaka, Japan

[73] Assignee: Fujicopian Co., Ltd., Osaka, Japan

[21] Appl. No.: 572,208

[22] Filed: Dec. 13, 1995

[30] Foreign Application Priority Data

Dec. 27, 1994 [JP] Japan ..... 6-324856

[51] Int. Cl.[6] ..... B41J 31/16; B41J 32/02

[52] U.S. Cl. ..... 400/202.4; 400/207; 400/197

[58] Field of Search ..... 400/207, 196, 400/202.4, 194, 195, 190.1, 208, 197

[56] References Cited

U.S. PATENT DOCUMENTS

| | | | |
|---|---|---|---|
| 5,211,490 | 5/1993 | Suzawa et al. | 400/202.4 |
| 5,401,108 | 3/1995 | Debreczenyi | 400/202.4 |
| 5,472,286 | 12/1995 | Uemura et al. | 400/196.1 |

FOREIGN PATENT DOCUMENTS

| | | | |
|---|---|---|---|
| 403051171 | 5/1991 | Japan | 400/208 |
| 403051170 | 5/1991 | Japan | 400/208 |
| 6324856 | 12/1994 | Japan . | |

*Primary Examiner*—Edgar S. Burr
*Assistant Examiner*—Dave Ghatt
*Attorney, Agent, or Firm*—Felfe & Lynch

[57] ABSTRACT

An ink ribbon cassette repeatedly usable for an extended period of time by replenishment of ink to an ink ribbon after each printing operation. The cassette includes a cassette casing, an ink-storing member disposed within the cassette casing and storing ink liquid as absorbed therein, an ink-absorbing member disposed within the cassette casing for absorbing the ink liquid from the ink-storing member through contact thereof with the ink-storing member. A wall member is disposed within the cassette casing and encasing the ink-storing member and the ink-absorbing member, the wall member defining an opening for allowing a portion of the ink-absorbing member to be exposed therethrough to the outside. A replenishing roll is provided to be rotatable while elastically contacting the ink-absorbing member through the opening so as to replenish the ink liquid to an ink ribbon being moved. The ink-storing member and the ink-absorbing member together form a gap at mutually contacting portions thereof registered with the opening so as to allow flection of the portion of the ink-absorbing member toward the ink-storing member in association with the contact therebetween.

9 Claims, 4 Drawing Sheets

INK RIBBON CASSETTE

BACKGROUND OF THE INVENTION

1. Field of the Invention

The present invention relates to an ink ribbon cassette, and more particularly to an ink ribbon cassette repeatedly usable for an extended period of time by replenishment of ink to an ink ribbon after each printing operation.

2. Description of the Related Art

According to a conventional ink ribbon cassette, an ink-absorbing member is interposed between an inner face of a wall member and an ink-storing absorbent member with the ink-absorbing member closing an opening defined in the wall member. Further, the ink-absorbing member and the ink-storing absorbent member are placed in contact with each other through entire opposing faces of the respective members including those portions of the faces corresponding to the wall opening (for example, Japanese laid-open utility model No. Hei. 4-117766).

The ink-storing absorbent member to be used in an ink ribbon cassette of the above-described type is comprised of a material capable of absorbing ink in the form of liquid, such as nonwoven fabric, fiber web, sponge or the like, and the ink-absorbing member is comprised of such material as felt. Because of this, these members, when fabricated, are apt to have size irregularity. Then, when the ink-storing absorbent member and the ink-absorbing member, if fabricated at the upper limit of their dimensional tolerances, are assembled within the wall member of a cassette casing, both of these members are set therein in a compressed state, thereby causing a portion of the ink-absorbing member to project or bulge to the outside through the opening of the wall member. This in turn increases the pressure of contact between the bulging portion of the ink-absorbing member and an ink replenishing roll, leading to inadvertent increase in the amount of ink liquid to be transferred from the ink-absorbing member to the replenishing roll for ink replenishment. More specifically, the replenishing roll will collect, by scraping, an excessive amount of ink from the ink-absorbing member; and as this excess ink is supplied to the ink ribbon and this ink ribbon is used for printing, there occurs such printing trouble as ink bleeding.

Conversely, if the ink-absorbing member and the ink-storing absorbent member are fabricated at the lower limit of their dimensional tolerances, then, when these members are assembled within the wall member of the cassette casing, there will be formed a gap between the ink-absorbing member and the ink-storing absorbent member. As a result, the contact pressure between the bulging portion of the ink-absorbing member and the replenishing roll will be reduced, thereby to decrease the amount of ink liquid supplied and transferred from the ink-absorbing member to the roll. This results in excessive decrease in the amount of ink liquid to be scraped off by the roll from the ink-absorbing member. Then, with the resultant deficiency in the amount of ink liquid to be replenished to the ink ribbon, there tends to occur a printing trouble such as blurring or obscure printing.

In view of the above-described state of the art, a primary object of the present invention is to provide an ink ribbon cassette which may restrict excessive variation in the pressure of contact between the ink-absorbing member and the replenishing roll in spite of possible presence of some dimensional tolerances in the ink-storing absorbent member and the ink-absorbing member, so that the ink may always be replenished by an appropriate amount so as to avoid the printing troubles such as ink bleeding and blurring.

SUMMARY OF THE INVENTION

For accomplishing the above-noted object, an ink ribbon cassette, according to the present invention, comprises:

a cassette casing;

an ink-storing member disposed within the cassette casing and storing ink liquid as absorbed therein;

an ink-absorbing member disposed within the cassette casing for absorbing the ink liquid from the ink-storing member through contact thereof with the ink-storing member;

a wall member disposed within the cassette casing and encasing the ink-storing member and the ink-absorbing member, the wall member defining an opening for allowing a portion of the ink-absorbing member to be exposed therethrough to the outside;

a replenishing roll rotatable while elastically contacting the ink-absorbing member through the opening so as to replenish the ink liquid to an ink ribbon being moved; and wherein, the ink-storing member and the ink-absorbing member together form a gap at mutually contacting portions thereof registered with the opening so as to allow flection of the portion of the ink-absorbing member toward the ink-storing member in association with the contact therebetween.

According to the above-described construction, when the ink-storing member and the ink-absorbing member both fabricated at the upper limit of their dimensional tolerances are assembled within the wall member of the cassette casing, the ink-storing member and the ink-absorbed member are compressed against each other, so that a portion of the ink-absorbing member bulges and is exposed to the outside through the opening of the wall member. However, when this ink-absorbing member is brought into pressure-contact with the replenishing roll, the bulging portion of the ink-absorbing member is allowed to reversely flex into the gap formed at the portion corresponding to the opening between the ink-storing member and the ink-absorbing member. Accordingly, it is possible to prevent the contact pressure between the replenishing roll and the ink-absorbing member from being increased excessively.

Therefore, whether the ink-storing member and the ink-absorbing member are manufactured with either the upper or lower limit of their dimensional tolerances and assembled within the wall member of the cassette casing, there occurs no significant variation in the contact pressure between the replenishing roll and the ink-absorbing member.

As a result, with this ink ribbon cassette of the invention, there occurs less variation in the amount of ink liquid transferred from the ink-absorbing member to the replenishing roll, so that the ink ribbon may invariably be replenished with an appropriate amount of ink liquid so as to avoid blurring or ink bleeding in the printing.

The gap may be provided as a recess defined in the ink-storing member.

In this case, the recess providing the gap may be formed at the time of fabrication of the ink-storing member. Also, the ink-storing member and the ink-absorbing member may be assembled in the same manner as in the conventional construction.

Hence, the afore-said object may be fulfilled while restricting increase in the manufacture expense of the ink ribbon cassette.

Further, alternatively, the gap may be provided by causing the portion of the ink-absorbing member registered with the opening to be flexed to project toward the replenishing roll.

With this construction, in comparison with the construction forming the gap by means of the recess defined in the ink-storing member, there occurs no disadvantageous reduction in the storage capacity of the ink-storing member.

As a result, the appropriate amount of ink may be replenished for avoiding bleeding or blurring of the printing without inviting disadvantageous in the amount of the ink liquid to be absorbed and stored within the ink-storing member.

According to a further aspect of the invention, the ink-storing member and the ink-absorbing member are formed integrally with each other, and the gap is defined at a portion of the integral member corresponding in position to the opening.

With this construction, as the ink-storing member and the ink-absorbing member are formed as one integral member, there occurs no relative positioning error between the ink-storing member and the ink-absorbing member when these members are assembled within the space encased by the wall member. Hence, as compared with the construction in which the ink-storing member and the ink-absorbing member are provided as two separate members, the assembly operation may be facilitated.

As a result, with the improvement of the efficiency of the assembly operation of the ink-storing member and the ink-absorbing member, it is possible to restrict increase in the manufacturing expense of the ink ribbon cassette.

According to a still further aspect of the invention, the ink ribbon cassette further comprises a restricting member disposed within the gap adjacent the replenishing roll at least at one of opposed longitudinal sides of the ink-absorbing member for coming into contact with the ink-absorbing member flexed toward the ink-storing member so as to restrict localized compression deformation of the ink-storing member in association with the flection of the ink-absorbing member.

With the above-described construction, when the ink-absorbing member is flexed in association with the contact thereof with the replenishing roll, there occurs no or almost no localized compression deformation of the corner portion of the ink-absorbing member toward the roll corresponding to the restricting member inside the gap. Thus, when the ink-storing member impregnated in advance with the ink and the ink-absorbing member are assembled in the ink ribbon cassette, the ink replenishment to the ink ribbon may take place appropriately without causing ink bleeding or blurring from the beginning of the use of the ink ribbon cassette.

Further and other objects, features and effects of the invention will become more apparent from the following more detailed description of the embodiments of the invention with reference to the accompanying drawings.

DETAILED DESCRIPTION OF THE PREFERRED EMBODIMENTS

[FIRST EMBODIMENT]

Figure 1:
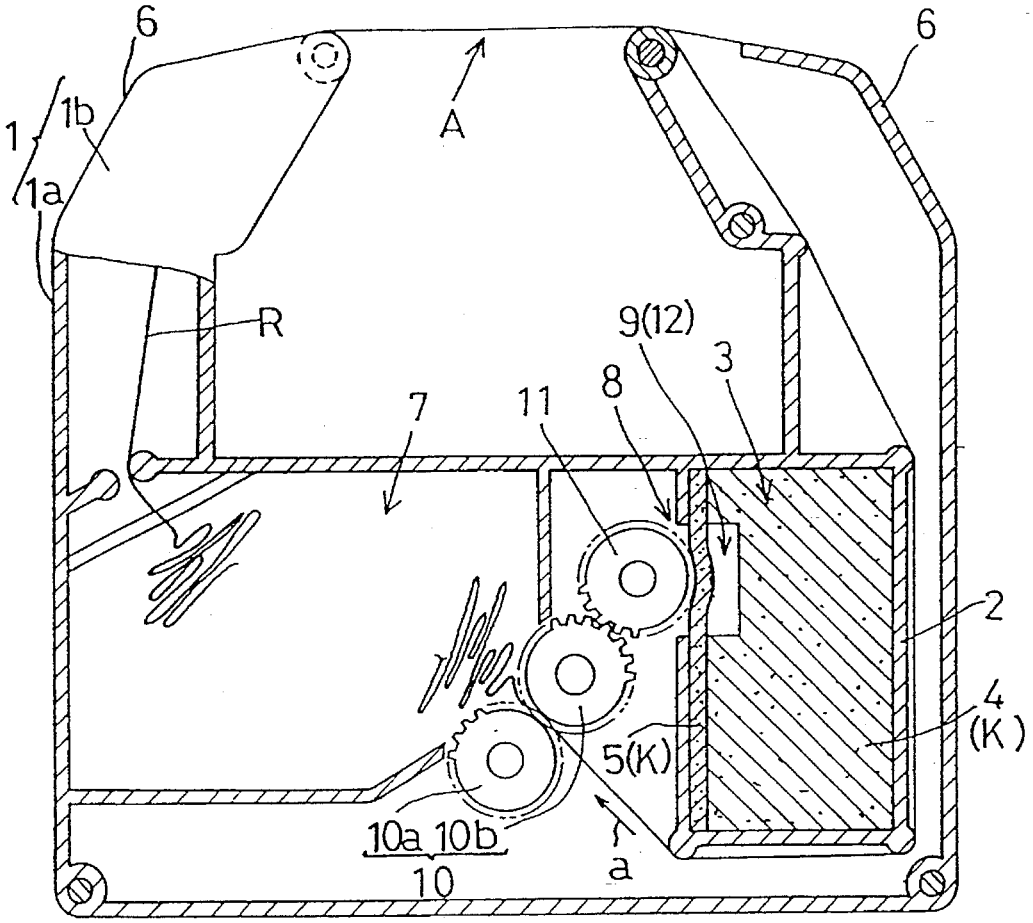
FIG. 1 is a section view showing inside of an ink ribbon cassette according to a first preferred embodiment of the invention.

FIG. 1 shows a cassette casing 1 comprising a combination of a box case 1*a* made of synthetic resin and having a top opening and a cover case 1*b* made of synthetic resin and covering the top opening of the box case 1*a*. The box case 1*a* integrally forms therein a wall member 2 which in turn defines therein a chamber 3 for housing an ink-replenishing unit K. The ink-replenishing unit K includes an ink-storing absorbent member 4 within which ink liquid is absorbed and stored and an ink-absorbing member 5 capable of absorbing the ink liquid from the ink-storing absorbent member 4. Then, in operation, an endless ink ribbon R being moved is replenished with the ink liquid stored in the ink-storing absorbent member 4 housed within the ink-replenishing unit housing chamber 3.

The cassette casing 1 forms a pair of right and left ribbon guide arms 6 and defines therein a ribbon housing chamber 7 in which the ink ribbon R is stored in a folded state. The box case 1*a* integrally forms tubular portion, while the cover case 1*b* integrally form corresponding pin portions. Then, by inserting the pin portions of the cover case 1*b* into the tubular portions of the box case 1*a* for mating, the cover case 1*b* is secured to the box case 1*a*. The pair of opposing ribbon guide arms 6 define therebetween a printing section A where a printing operation is to take place by means of the ink ribbon R running between these arms in cooperation with an impact dot printing head (not shown).

The ink-storing absorbent member 4 is fabricated by forming such absorbent material capable of absorbing the ink liquid as nonwoven fabric, fiber web, a polyurethane sponge or the like into a shape of rectangular block and this member 4 is then impregnated in advance with the ink liquid. The ink-absorbing member 5 is fabricated by forming such material as felt capable of absorbing the ink liquid into a shape of a plate.

The wall member 2 defines an opening 8 for allowing a portion of the ink-absorbing member to be exposed therethrough to the inside of the cassette case 1 and to the outside of the ink-replenishing unit housing chamber 3. Then, the ink-absorbing member 5 is fitted between a peripheral edge of the opening 8 and the ink-storing member in such a manner as to close the opening 8.

At the mutually contacting portions of the ink-storing member 4 and the ink-absorbing member 5 and at the position registered with the opening 8, the ink-storing member 4 defines a recess 9 formed as a cutout.

Adjoining an entrance opening of the ribbon housing chamber 7, there is provided a ribbon drive section 10 for driving the ink ribbon R between the printing section A and the ribbon housing chamber 7 in a peripheral direction denoted with an arrow (a) in FIG. 1.

The ribbon drive section 10 includes a driving feed roll 10*a* driven to rotate by receiving a force from a printer and a driven feed roll 10*b* driven by the driving feed roll 10*a*. Then, the ink ribbon R is nipped between the driving feed roll 10*a* and the driven feed roll 10*b*. So that, in association with the driving rotation of the driving feed roll 10*a*, the ink ribbon R is withdrawn from the ribbon housing chamber 7 to move through the printing section A. Then, the ribbon after the printing is further moved back into the ribbon housing chamber 7 to be folded therein for a next use.

For providing the above function, the two feed rolls 10*a*, 10*b* are operatively coupled with each other by means of meshing between gear portions formed on outer peripheral faces of the respective rolls 10*a*, 10*b*.

Further, between the ribbon drive section 10 and the opening 8 of the wall member 2, there is provided a replenishing roll 11 having a gear portion formed on an outer peripheral face thereof extending in a width direction of the ribbon. This replenishing roll 11 meshes with the driven feed roll 10*b* to be driven to rotate in unison therewith. Also, the replenishing roll 11 is placed in elastic contact through the opening 8 with the ink-absorbing member 5 so as to force this ink-absorbing member 5 to be elastically deformed into the recess 9 of the ink-storing member 4.

Namely, the recess 9 constitutes a gap 12 for allowing flection of the ink-absorbing member 5 toward the ink-storing member 4 in association with the contact with the replenishing roll 11. Because of the presence of this gap 12, when the ink-storing member 4 and the ink-absorbing member 5 when both fabricated with the lower limit of their dimensional tolerances are assembled within the ink-replenishing unit housing chamber 3 or when the ink-storing member 4 and the ink-absorbing member 5 when both fabricated at the upper limit of their dimensional tolerances are assembled within the ink-replenishing unit housing chamber 3 in such a manner as to establish a predetermined contact pressure between the replenishment roll 11 and the ink-absorbing member 5, the ink-absorbing member 5 is flexed toward the ink-storing member 4 when the replenishing roll 11 presses the ink-absorbing member 5 toward the ink-storing member 4, whereby the contact pressure between the replenishing roll 11 and the ink-absorbing member 5 is prevented from being built up excessively.

Because of the presence of the recess 9, the ink-absorbing member 5 is held between and by the inner face of the wall member 2 and the ink-storing member 4. Therefore, the ink liquid stored and absorbed within the ink-storing member 4 is transferred to the ink-absorbing member 5 through osmosis from the former to the latter at two longitudinally opposed locations of the ink-absorbing member 5 where the ink-storing member 4 and the ink-absorbing member 5 are placed in contact with each other. Then, the ink liquid absorbed at these two locations osmosis to the portion of the ink-absorbing member 5 placed in contact with the replenishing roll 11 to be transferred thereto. In this manner, the ink liquid may be supplied efficiently to the mutually contacting portions of the ink-absorbing member 5 and the replenishing roll 11. Accordingly, as compared with a further construction in which the ink-absorbing member 5 has one end thereof supported and held cantilever-wise between the wall member 2 and the ink-storing member 4, the replenishment of the ink liquid to the replenishing roll 11 may always take place in a stable manner.

Further, the pressing force exerted from the replenishing roll 11 to the ink-absorbing member 5 toward the ink-storing member 4 may be distributed through the two held and supported portions of the ink-absorbing member 5. Hence, in comparison with the further construction in which the ink-absorbing member 5 has its one end supported and held cantileverwise between the wall member 2 and the ink-storing member 4, the above-described construction prevents permanent deformation of the ink-absorbing member 5 in the vicinity of its supported portion due to stress concentration.

Now in operation, when the replenishing roll 11 is rotated in association with rotation of the driven feed roll 10*b*, the ink liquid absorbed in the ink-absorbing member 5 is scraped off by the outer peripheral face of the replenishing roll 11. Then, this ink liquid scraped off by the replenishing roll 11 is transferred to the outer peripheral face of the driven feed roll 10*b*, and the ink liquid transferred to the driven feed roll 10*b* is applied consequently to the ink ribbon R. Thereafter, this ink ribbon R applied with the ink liquid is introduced into the ink-replenishing unit housing chamber 3.

Incidentally, the opening width of the opening 8 of the wall member 2 and the opening width of the recess 9 constituting the gap 12 are sized to be equal to the diameter of the replenishing roll 11.

[SECOND EMBODIMENT]

Figure 2:
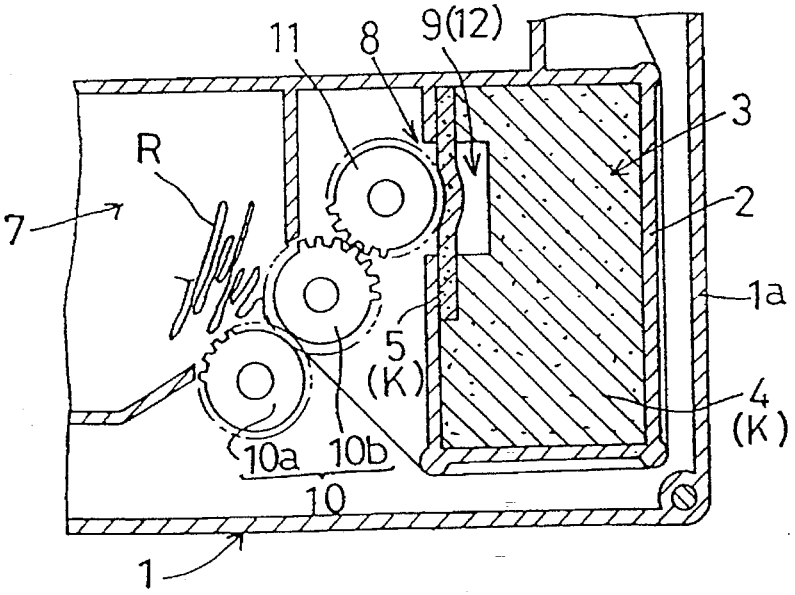
FIG. 2 is a section view showing principal portions of a construction according to a second embodiment.

In the first embodiment, the ink-absorbing member 5 is formed so as to extend over the entire width of one side face of the ink-storing member 4. Instead, as shown in FIG. 2, the ink-absorbing member 5, which is located adjacent the one side face of the ink-storing member 4 at the position registered with the opening 8, may be formed so as to extend slightly longer than the width of the opening 8.

Namely, as long as the ink-absorbing member 5 is fitted between the peripheral edge of the opening 8 of the wall member 2 and the ink-storing member 4 so as to close the opening 8, the ink-absorbing member 5 does not need to extend over the entire width of the one side face of the ink-storing member 4.

The other portions of the construction of this embodiment are identical to those of the first embodiment.

[THIRD EMBODIMENT]

Figure 3:
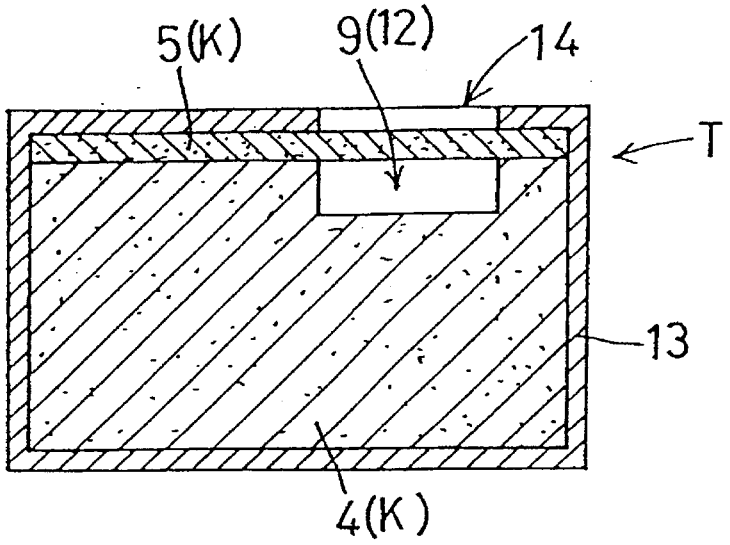
FIG. 3 is a section view of an ink tank relating to a third embodiment of the invention.

FIG. 3 shows an ink tank T of a cartridge type. In this cartridge type ink tank T, the ink-replenishing unit K including the ink-storing member 4 storing the ink liquid as absorbed therein and the ink-absorbing member 5 capable of absorbing the ink stored within the ink-storing member 4 through contact with this member 4 is accommodated within a case 13 made of synthetic resin and constituting the ink tank T.

The case 13 defines an opening 14 through which a portion of the ink-absorbing member 5 is exposed to the outside; and the ink-absorbing member 5 is fitted between the peripheral edge of the opening 14 and the ink-storing member 4 with the ink-absorbing member 5 closing the opening 14.

Figure 4:
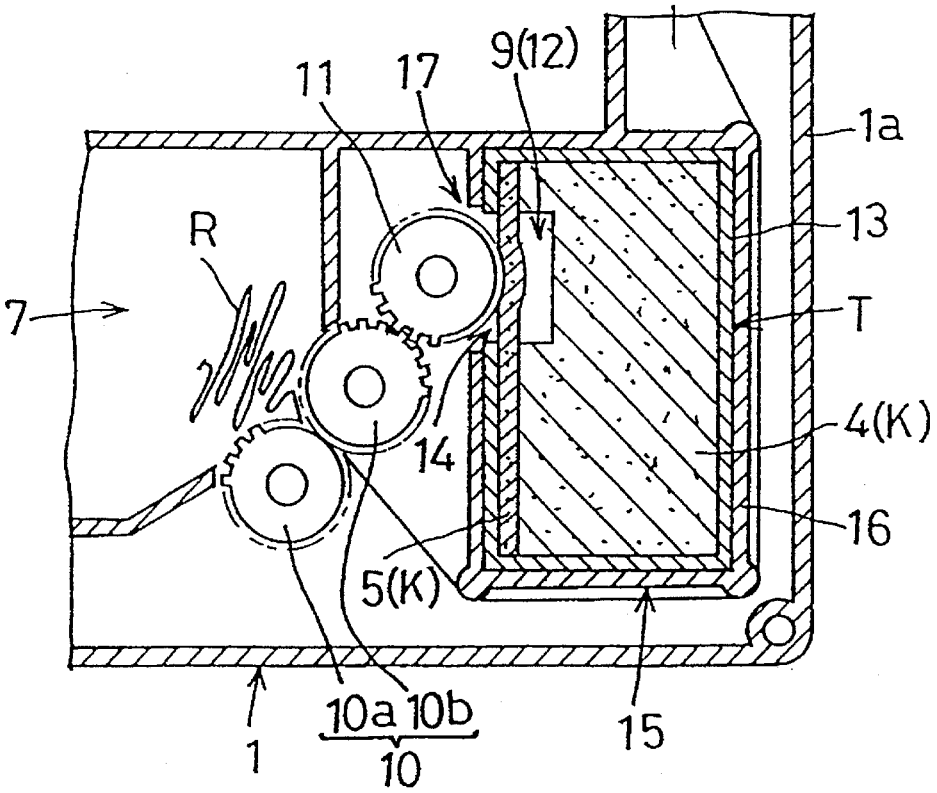
FIG. 4 is a section view showing a condition where the ink tank of FIG. 3 is attached within a cassette casing.

FIG. 4 shows an ink ribbon cassette having a different construction adapted for accommodating the ink tank T described above. Namely, in this ink ribbon cassette, the ink tank T is detachably attached within an ink-tank housing chamber 15 which is provided in place of the ink-replenishing unit housing chamber 3 in the cassette case 1 of the first embodiment, so that the ink liquid stored within the ink-storing member 4 housed inside the ink tank T may be replenished to the endless ink ribbon R which is being run.

At the position registered with the opening 14 in the area where the ink-storing member 4 is placed in contact with the ink-absorbing member 5, the ink-storing member 4 defines a recess 9 as a cutout.

A wall member 16 partitioning the ink-tank housing chamber 14 defines, at a portion corresponding to the opening 14 of the ink tank T, an opening 17 configured substantially identical to the opening 14. Then, the replenishing roll 11 is placed under elastic contact with the ink-absorbing member 5 through the two openings 14, 17, with the roll 11 forcing the ink-absorbing member 5 to be elastically deformed into the recess 9 of the ink-storing member 4.

That is to say, the recess 9 constitutes the gap 12 for allowing flexing deformation of the ink-absorbing member 5 toward the ink-storing member 4 in association with its contact with the replenishing roll 11. Because of the presence of this gap 12, when the ink tank T is attached within the ink-tank housing chamber 15, the ink-absorbing member 5 is not directly subjected to a reaction force from the ink-storing member 4 against the pressing force exerted by the replenishing roll 11 to the ink-absorbing member 5 toward the ink-storing member 4, thereby to restrict excessive build-up in the contact pressure between the replenishing roll 11 and the ink-absorbing member 5.

The other portions of the construction of this embodiment are identical to those of the first embodiment.

[FOURTH EMBODIMENT]

Figure 5:
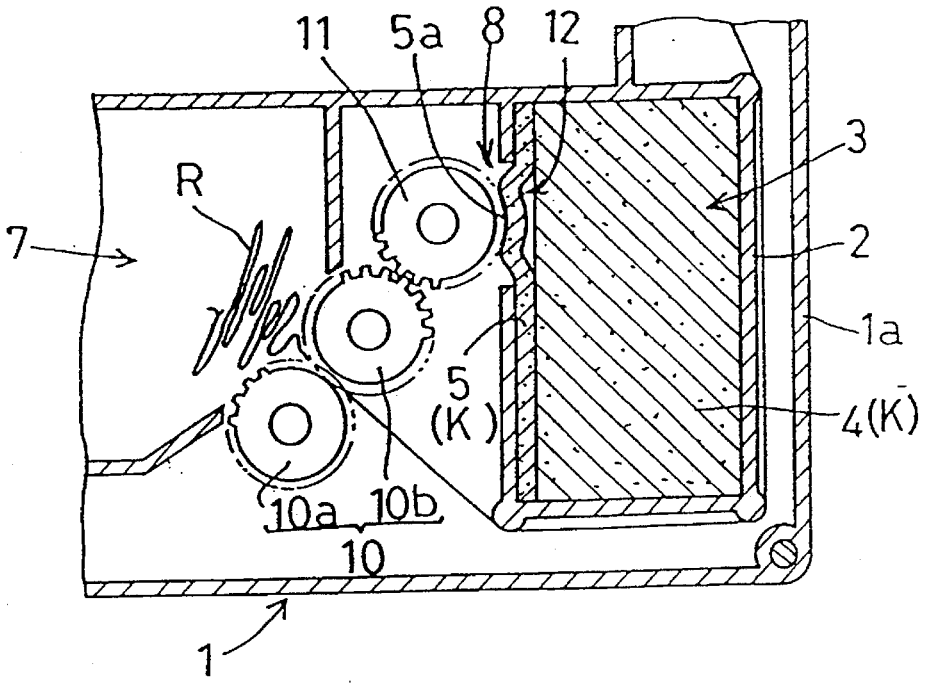
FIG. 5 is a section view showing principal portions of a construction according to a fourth embodiment.

FIG. 5 shows a construction according to a further embodiment in which an ink-storing member 4 not having the recess 9 unlike the ink-storing member 4 used in the first embodiment is housed within the ink-replenishing unit housing chamber 3. Further, in this embodiment, the portion of the ink-absorbing member 5 registered with the opening 8 of the wall member 2 is flexed to project from the ink-replenishing unit housing chamber 3 toward the replenishing roll 11. And, this projecting portion 5*a* and the one side face of the ink-storing member 4 define therebetween the gap 12 for allowing flexing deformation of the ink-absorbing member 5 toward the ink-storing member 4 in association with the contact with the replenishing roll 11.

The other portions of the construction of this embodiment are identical to those of the first embodiment.

[FIFTH EMBODIMENT]

Figure 6:
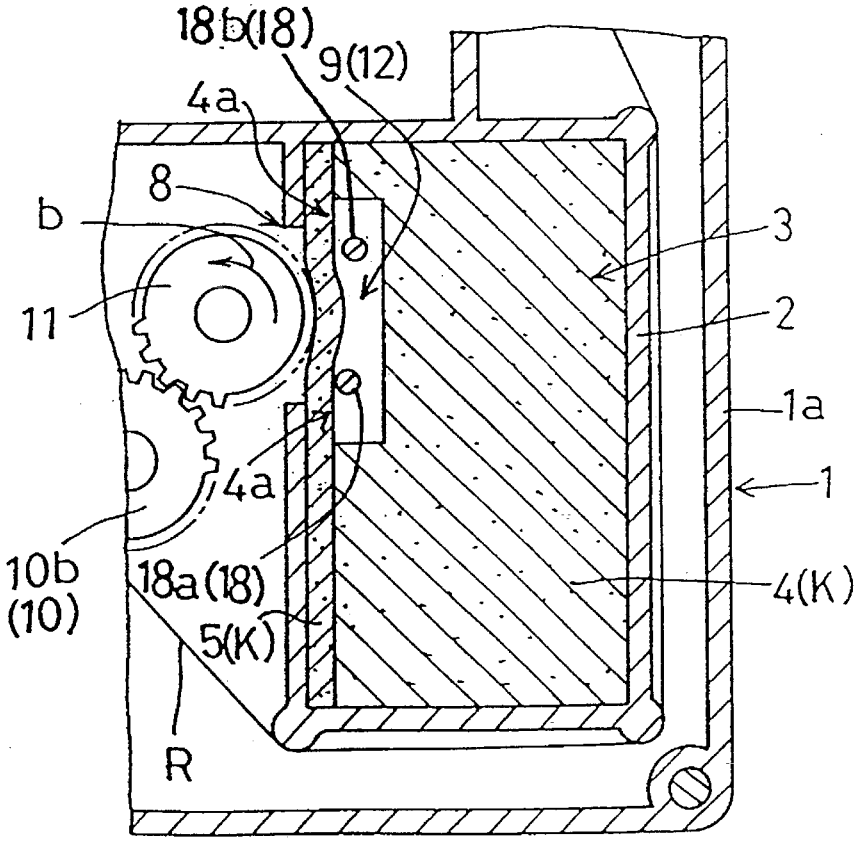
FIG. 6 is a section view showing principal portions of a construction according to a fifth embodiment.

FIG. 6 shows a construction according to a still further embodiment. In this, in the construction of the first embodiment, there are additionally provided a pair of pin type restricting members 18*a*, 18*b* which are disposed within the recess 9 of the ink-storing member 4 constituting the gap 12 on the side adjacent the replenishing roll 11 and in the vicinity of right and left projecting corners 4*a*, 4*a* of the ink-storing member 4 on the opposed longitudinal sides of the ink-absorbing member 5. With this, the flexing movement of those portions, adjacent the projecting corners 4*a*, 5*a*, of the ink-absorbing member 5 which effects the flexing deformation toward the ink-storing member 4 may be restricted by contact between these portions 18, the one restricting member 18*a* which is disposed on the upstream side in a rotational direction (b) of the replenishing roll 11 is disposed at a position contacting the side face opposed to the recess 9 of the ink-absorbing member 5 which in turn is out of contact with the replenishing roll 11. The other restricting member 18*b* is disposed at such a position contacting the side face opposed to the recess 9 of the ink-absorbing member 5 that when the ink-absorbing member 5 is flexed toward the ink-storing member 4 by an amount exceeding a predetermined amount in association with the contact of the member 5 with the replenishing roll 11, the other restricting member 18*b* comes into contact with the side face of the ink-absorbing member 5 facing the recess 9.

Further, the area of the contact between the ink-storing member 4 and the ink-absorbing member 5 should be adjusted through adjustments of the width of the recess 9 of the ink-storing member 4 relative to the longitudinal direction of the ink-absorbing member, the length of the ink-absorbing member 5 or the like depending on the viscosity of the ink liquid, the composition of the ink liquid, the materials, and on densities of the ink-storing member 4 and the ink-absorbing member 4, so that the replenishing amount of the ink to be transferred through osmosis between the ink-storing member 4 and the ink-absorbing member 5 may be appropriate.

In the case of this embodiment, when the ink-absorbing member 5 is flexed and deformed into the recess 9 of the ink-storing member 4 due to the contact pressure between the ink-absorbing member 5 and the replenishing roll 11, this deformation does not cause the two projecting corners 4*a*, 4*a* of the ink-storing member 4 to be pressed against the ink-absorbing member 5. As a result, there occurs no localized compression deformation of the ink-storing member 4 at its projecting corners 4*a*, 4*a*.

The other portions of the construction of this embodiment are identical to those of the first embodiment.

[SIXTH EMBODIMENT]

Figure 7:
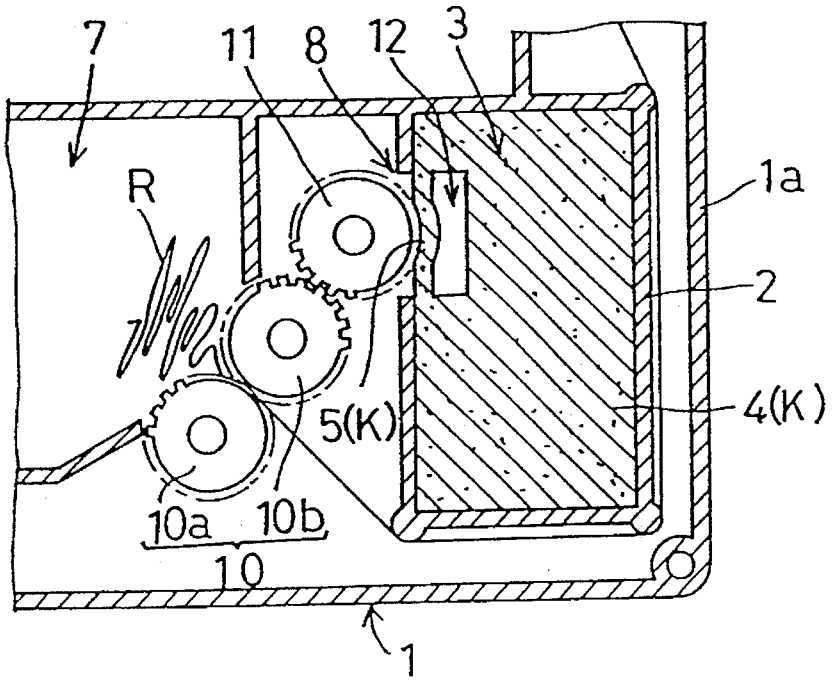
FIG. 7 is a section view showing principal portions of a construction according to a sixth embodiment.

FIG. 7 shows a construction according to a still further embodiment of the invention. In this, instead of the ink-storing member 4 and the ink-absorbing member 5 together constituting the ink-replenishing unit K in the first embodiment, the ink-storing member 4 and the ink-absorbing member 5 are formed integrally with each other of a same material capable of absorbing the ink liquid such as the nonwoven fabric, fiber web, sponge of polyurethane or the like.

Further, at the position registered with the opening 8 defined in the wall member 2 constituting the ink-replenishing unit housing chamber 3 (i.e. at the position where the recess 9 is provided in the first embodiment), there is formed an inner gap 12 for allowing flexing deformation of the ink-absorbing member 5 formed integral with the ink-storing member 4 toward the ink-storing member 4.

In this case, due to the integral formation of the ink-storing member 4 and the ink-absorbing member 5 together constituting the ink-replenishing unit K, in comparison with the case where the ink-storing member 4 and the ink-absorbing member 5 are provided as two separate elements, there can be obtained advantages in terms of handling convenience, such as in the storage of parts and assembly.

The other portions of the construction of this embodiment are identical to those of the first embodiment.

[SEVENTH EMBODIMENT]

Figure 8:
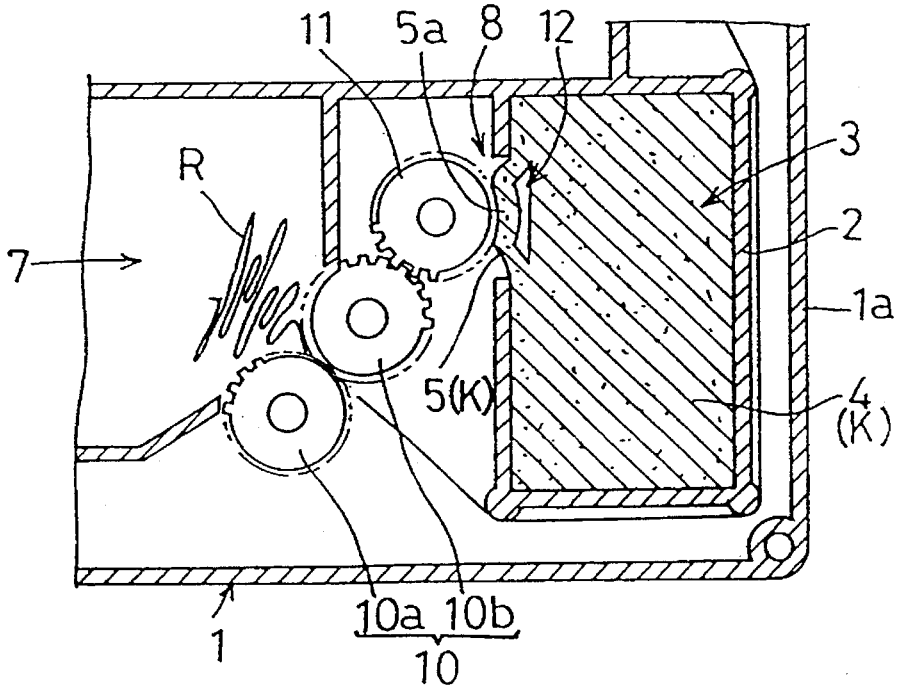
FIG. 8 is a section view showing principal portions of a construction according to a seventh embodiment.

FIG. 8 shows a construction according to a still further embodiment of the invention. In this, instead of the ink-storing member 4 and the ink-absorbing member 5 together constituting the ink-replenishing unit K in the fourth embodiment, the ink-storing member 4 and the ink-absorbing member 5 are formed integrally with each other of a same material capable of absorbing the ink liquid such as the nonwoven fabric, fiber web, sponge of polyurethane or the like.

With the construction of this embodiment, like with the construction of the sixth embodiment described above, there can be obtained advantages in terms of handling convenience, such as in the storage of parts and assembly.

The other portions of the construction of this embodiment are identical to those of the fourth embodiment.

[OTHER EMBODIMENTS]

(1) The constructions of the first through seventh embodiments may be employed in appropriate combinations.

For instance, in place of the construction of the ink-storing member 4 and the ink-absorbing member 5 of the third embodiment shown in FIGS. 3 and 4, the ink-storing member 4 and the ink-absorbing member 5 configured according to the fourth embodiment and shown in FIGS. 5 may be housed within the case 13 employed in the third embodiment.

Further, the restricting members 18*a*, 18*b* employed in the fifth embodiment and shown in FIG. 6 may be provided at the recess 9 of the second embodiment shown in FIG. 2. Likewise, the restricting members 18*a*, 18*b* of the fifth embodiment may be provided at the recess 9 of the third embodiment.

Still further, these restricting members 18*a*, 18*b* of the fifth embodiment may be disposed within the gap 12 of the sixth embodiment adjacent the replenishing roll 11 and at the opposed longitudinal sides of the ink-absorbing member 5.

The specific combinations of the constructions according to the first through seventh embodiment are not limited to those mentioned above, but can be made in any other manner.

(2) In the respective embodiments described supra, the replenishing roll 11 is interposed between the driven feed roll 10*b* and the ink-absorbing member 5 to be placed in contact therewith, so that the replenishing roll 11 is rendered rotatable in association with rotation of the driven feed roll 10*b*. Alternately, a replenishing roll 11 which is adapted to be independently rotatable can be interposed between the ink ribbon R and the ink-absorbing member 5 to be placed in contact therewith.

(3) In the foregoing embodiments described above, the replenishing roll 11 is transfers the scraped-off ink liquid to the ink ribbon R via the driven feed roll 10*b*. Instead, by disposing the driven feed roll 10*b* between the ink ribbon R and the ink-absorbing member 5 to be placed in contact therewith, the driven feed roll 10*b* can be adapted to function also as the replenishing roll.

(4) In the first through fifth embodiments, the ink-storing member 4 and the ink-absorbing member 5 together constituting the ink-replenishing unit K are formed separately of differing materials. Instead, these ink-storing member 4 and the ink-absorbing member 5 can be formed separately of a same material capable of absorbing the ink liquid, such as nonwoven fabric, fiber web, sponge of polyurethane or the like. The specific types of the materials to be used may vary depending on the convenience.

(5) In the fifth embodiment, the restricting members 18*a*, 18*b* are provided within the recess 9 adjacent the replenishing roll 11 and at the opposed longitudinal sides of the ink-absorbing member 5. The construction of the restricting members is not limited thereto. Instead, the one restricting member 18*b* disposed on the downstream side in the rotational direction (b) of the replenishing roll 11 may be eliminated.

(6) In the constructions shown in the figures, the ink-absorbing member 5 has its both opposed ends held and supported to the wall member 2, 13 and the ink-storing member 4. The invention is not limited to such two-end holding construction. Instead, only one end of the ink-absorbing member can be supported. In this case, preferably, the ink-absorbing member 5 should be supported either with forming the gap 12 shallower to reduce the space into which the ink-absorbing member 5 may escape or by additionally providing an elastic element such as a spring for supporting the member 5.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. An ink ribbon cassette comprising:

a cassette casing;

an ink-storing member disposed within the cassette casing and storing ink liquid as absorbed therein;

an ink-absorbing member disposed within the cassette casing for absorbing the ink liquid from the ink-storing member through contact thereof with the ink-storing member;

a wall member disposed within the cassette casing and encasing the ink-storing member and the ink-absorbing member, the wall member defining an opening for allowing a portion of the ink-absorbing member to be exposed therethrough to the outside;

a replenishing roll rotatable while elastically contacting the ink-absorbing member through the opening so as to replenish the ink liquid to an ink ribbon being moved; and wherein, the ink-storing member and the ink-absorbing member together form a gap at mutually contacting portions thereof registered with the opening so as to allow flection of the portion of the ink-absorbing member toward the ink-storing member in association with the contact therebetween.

2. An ink ribbon cassette as claimed in claim 1, wherein said gap comprises a recess defined in said ink-storing member.

3. An ink ribbon cassette as claimed in claim 2, wherein an opening width of said opening of the wall member and an opening width of said recess are sized to be equal to a diameter of said replenishing roll.

4. An ink ribbon cassette as claimed in claim 3, wherein said ink-absorbing member is disposed adjacent one side face of said ink-storing member at a position registered with said opening and extends slightly longer than the opening width of said opening and shorter than an entire width of said one side face of the ink-storing member.

5. An ink ribbon cassette as claimed in claim 1, wherein said gap is formed by flection of the portion of the ink-absorbing member registered with the opening to project toward the replenishing roll.

6. An ink ribbon cassette as claimed in claim 5, wherein said ink-storing member and said ink-absorbing member are formed integral with each other of a same material.

7. An ink ribbon cassette as claimed in claim 1, further comprising an ink tank of a cartridge type detachably attached within said cassette casing, said ink tank including a case enclosing said ink-storing member and said ink-absorbing member so as to replenish the ink liquid stored within said ink-storing member to the ink ribbon being run.

8. An ink ribbon cassette as claimed in claim 1, further comprising a restricting member disposed within said gap adjacent the replenishing roll at least at one of opposed longitudinal sides of the ink-absorbing member for coming into contact with the ink-absorbing member flexed toward the ink-storing member so as to restrict localized compression deformation of the ink-storing member in association with the flection of the ink-absorbing member.

9. An ink ribbon cassette as claimed in claim 1, wherein said ink-storing member and said ink-absorbing member are formed as one integral unit, which defines therein said gap at a position registered with said opening.

* * * * *